US006171130B1

(12) United States Patent
Yoshida et al.

(10) Patent No.: US 6,171,130 B1
(45) Date of Patent: Jan. 9, 2001

(54) HALF-FITTING PREVENTION CONNECTOR

(75) Inventors: Haruki Yoshida; Motohisa Kashiyama, both of Shizuoka (JP)

(73) Assignee: Yazaki Corporation, Tokyo (JP)

( * ) Notice: Under 35 U.S.C. 154(b), the term of this patent shall be extended for 0 days.

(21) Appl. No.: 09/241,315

(22) Filed: Feb. 1, 1999

(30) Foreign Application Priority Data

Feb. 4, 1998 (JP) ..... 10-023461

(51) Int. Cl.[7] ..... H01R 13/62

(52) U.S. Cl. ..... 439/352; 439/350

(58) Field of Search ..... 439/352, 350, 439/353, 354, 355, 357, 358

(56) References Cited

U.S. PATENT DOCUMENTS 5,082,455 * 1/1992 Wei ..... 439/352
5,362,248 * 11/1994 Hashiguchi et al. ..... 439/352

FOREIGN PATENT DOCUMENTS 5-81967 * 11/1993 (JP) ..... H01R/13/639

* cited by examiner

*Primary Examiner*—Steven L. Stephan
*Assistant Examiner*—Eugene G. Byrd
(74) *Attorney, Agent, or Firm*—Sughrue, Mion, Zinn, Macpeak & Seas, PLLC

(57) ABSTRACT

A connector for preventing a half-fitting thereof comprises a first connector housing, a second connector housing for engaging with the first connector housing, a slide cover provided so as to cover an outer periphery of the second connector housing, the slide cover capable of sliding on the outer periphery of the second connector housing in a fitting direction of the first and second connector housing, resilient member provided in the second connector housing for urging the slide cover toward an anti-fitting direction, and at least three half-fitting detection mechanisms for detecting the half-fitting of the first and second connector housing respectively provided on outer face of front end portions of the first connector housing and the slide cover, the detection mechanisms arranged such that there are substantially equal intervals therebetween with respect to a circumferencial direction of the first connector housing and the slide cover.

4 Claims, 5 Drawing Sheets

HALF-FITTING PREVENTION CONNECTOR

BACKGROUND OF THE INVENTION

The present invention relates to a half-fitting prevention connector, used for electrically connecting wire harnesses in an automobile together, in which the condition of half-fitting between a pair of male and female connectors is detected through resiliency (urging force) of resilient members.

There have heretofore been known various types of half-fitting prevention connectors in which the condition of half-fitting between a pair of male and female connectors can be detected. One such example is disclosed in Unexamined Japanese Utility Model Publication No. 5-81967. FIG. 5 is a partly-broken, exploded perspective view of the related half-fitting prevention connector.

This related half-fitting prevention connector 51 comprises a pair of male and female connectors 54 and 55 having male terminals 52 and female terminals 53 mounted therein, respectively. Springs (resilient members) 56, acting in an anti-fitting direction, are mounted on the female connector 55, and lock mechanisms 57 are provided at the male and female connectors 54 and 55.

The male connector 54 has a box-shaped body with open front and rear sides, which is formed by a top plate 58, a bottom plate 59 and side plates 60, and the plurality of male terminals 52 are received in this male connector. The male connector can be fitted into the female connector 55, and the male terminals 52 can be fitted respectively into the female terminals 53, received in the female connector 55, to be electrically connected thereto.

A notch is formed in a central portion of each of the opposite side plates 60, and a retaining piece portion 61, serving as part of the lock mechanism 57, is formed integrally with the side plate 60, and extends forwardly in this notch. A distal end of the retaining piece portion 61 is disposed slightly rearwardly of a front edge of the side plate 60, and is so elastic as to be slightly bent (elastically deformed) outwardly. An inwardly-projecting retaining claw 62 is formed on an inner face of the front end portion of the retaining piece portion 61.

Spring receiving portions 63 are formed respectively at opposite sides of the female connector 55, and each spring receiving portion 63 receives the associated spring 56, and supports a rear end thereof. A spring guide rod 64 is provided within the spring receiving portion 63, and extends forwardly. A movable cover (slide member) 65 of a tubular shape with open front and rear sides, is mounted on the outer periphery of the female connector 55 for sliding movement in forward and backward directions. Spring receiving portions 66 are formed respectively at opposite sides of the movable cover 65, and cover the spring receiving portions 63, respectively. The front end of each spring 56 acts on the front end of the associated spring receiving portion 66 to urge the same forward. A retaining hole 70, serving as part of the lock mechanism 57, is formed in each of opposite side plates of the female connector 55.

Slots 67, formed through a top plate the movable cover 65, and projections 68, formed on a top plate of the female connector 55, serve to limit the forward movement of the movable cover 65 under the influence of the springs 56.

In the half-fitting prevention connector 51 of the above construction, when the pair of male and female connectors 54 and 55 are mated with each other at their front ends, and are pressed against each other, the front portion of the female connector 55 is first fitted into the front portion of the male connector 54, and then each retaining claw 62 slides over the side plate 69 of the female connector 55 while flexing the retaining piece portion 61 outwardly. As a result, the distal end of the retaining piece portion 61 and the retaining claw 62 abut against the front end surface of the associated spring receiving portion 66, so that the movable cover 65 is moved rearward while compressing the spring 56.

At this time, when the pair of male and female connectors 54 and 55 are pressed relative to each other, each spring 56 is further compressed, and each retaining claw 62 is retainingly engaged in the associated retaining hole 70, so that the flexed retaining piece portion 61 is restored into its original condition, and also the front end of the retaining piece portion 61 is disengaged from the front end surface of the spring receiving portion 66. Then, when the above pressing force is reduced or removed, the movable cover 65 is returned into its original position by the urging force of the springs 56, and the male and female connectors 54 and 55 are completely fitted together. At the same time, the male terminals 52 are completely connected to the female terminals 53, respectively. The outer faces of the side plates 60 are held in contact with the inner faces of the spring receiving portions 66, respectively, and therefore each retaining piece portion 61 can not be flexed outwardly. Therefore, each retaining claw 62 will not be disengaged from the associated retaining hole 70, and the male and female connectors 54 and 55 are completely locked relative to each other by the lock mechanisms 57.

However, if the pressing force for fitting purposes is reduced or removed in a condition of half-fitting between the pair of male and female connector, that is, before the retaining claw 62 of each lock mechanism 57 is retainingly engaged in the associated retaining hole 70, the male connector 54 is pushed back by the urging force of the springs 56, and therefore the connector is prevented from remaining in such a half-fitted condition.

In the above related half-fitting prevention connector 51, however, the pair of retaining piece portions 61 are provided respectively at the right and left sides, and therefore depending on the mounting positions of the male and female connectors 54 and 55 and on the fitting direction, there were encountered problems that the right and left forces failed to be uniformly applied when the male and female connectors were forcibly fitted together in a tilted manner, that the timing of engagement of the retaining claw 62 of one of the retaining piece portions 61 in the retaining hole 70 is different from the timing of engagement of the other retaining claw 62 in the retaining hole 70, and that only one of the retaining claws 62 was fitted into the retaining hole 70, and in these cases the connector remained in a half-fitted condition.

The male connector 54 is, in many cases, fixedly mounted on a vehicle body, and therefore is usually made of a rigid synthetic resin, such as a glass-containing resin, exhibiting little elasticity, and each time the pair of male and female connectors 54 and 55 are fitted and connected together, each retaining piece portion 61 is flexed outwardly. Furthermore, the distal end of the retaining piece portion 61 is pressed against the front end surface of the spring receiving portion 66 to compress the spring 56, and therefore when the connector is repeatedly operated, the retaining piece portions 61 are subjected to fatigue failure, and this problem must be overcome in order to achieve the high reliability of the connector.

SUMMARY OF THE INVENTION

With the above problems in view, it is an object of this invention to provide a half-fitting prevention connector in which the condition of half-fitting between a pair of male and female connectors can be positively detected during the fitting and connecting operation, and half-fitting detection mechanisms will not be subjected to fatigue failure, and the fitting operation can be carried out positively and easily.

In order to achieve the above object, there is provided a connector for preventing a half-fitting thereof comprising: a first connector housing; a second connector housing for engaging with the first connector housing; a slide cover provided so as to cover an outer periphery of the second connector housing, the slide cover capable of sliding on the outer periphery of the second connector housing in a fitting direction of the first and second connector housing; a resilient member provided in the second connector housing for urging the slide cover toward an anti-fitting direction; and at least three half-fitting detection mechanisms for detecting the half-fitting of the first and second connector housing respectively-provided on outer face of front end portions of the first connector housing and the slide cover, the detection mechanisms arranged such that there are substantially equal intervals therebetween with respect to a circumferencial direction of the first connector housing and the slide cover.

Accordingly, since the force acts uniformly on the plurality of half-fitting detection mechanisms, not only the fatigue strength is enhanced but also the half-fitting detection mechanisms will not be locked in the half-fitted condition, and therefore there can be obtained the half-fitting prevention connector having the high reliability.

Each of the half-fitting detection mechanisms includes an resilient piece rear end of which is cantilevered by the slide cover and having a slot extending in the fitting direction, and a rib for engaging with the slot provided on the first connector housing.

The second connector housing includes projections each rear face of which is to be abutted against a rear end of the associated slot to define an initial position of the slide cover, each front face of the ribs is brought into contact with a front end portion of the associated resilient piece to urge the slide cover toward the fitting direction when the slide cover is located at the initial position, and each front face of the projections is tapered for bending the associated front end portion of the resilient piece outwards to allow each of the rib to engage with the associated slot.

The second connector housing includes a resilient arm having a projection provided on outer face of a front end portion thereof and the first connector housing includes a retaining projection for engaging with the resilient arm, the projection is to be abutted against an inner face of the slide cover when the slide cover is located at the initial position, and a front face of the retaining projection is tapered to bend the resilient arm outwards when the slide cover is slid by the ribs.

Accordingly, the slide cover covers the projection when the slide cover is located at the initial position, and thus the resilient arm is prevented from moving by the projection unless the slide cover is intentionally moved rearward, and therefore the resilient arm will not be disengaged from the retaining projection. Therefore, the fitted condition of the first and second connectors will not be canceled by interference with other member, and there can be provided the half-fitting prevention connector having the higher reliability.

DETAILED DESCRIPTION OF THE PREFERRED EMBODIMENTS

Figure 1:
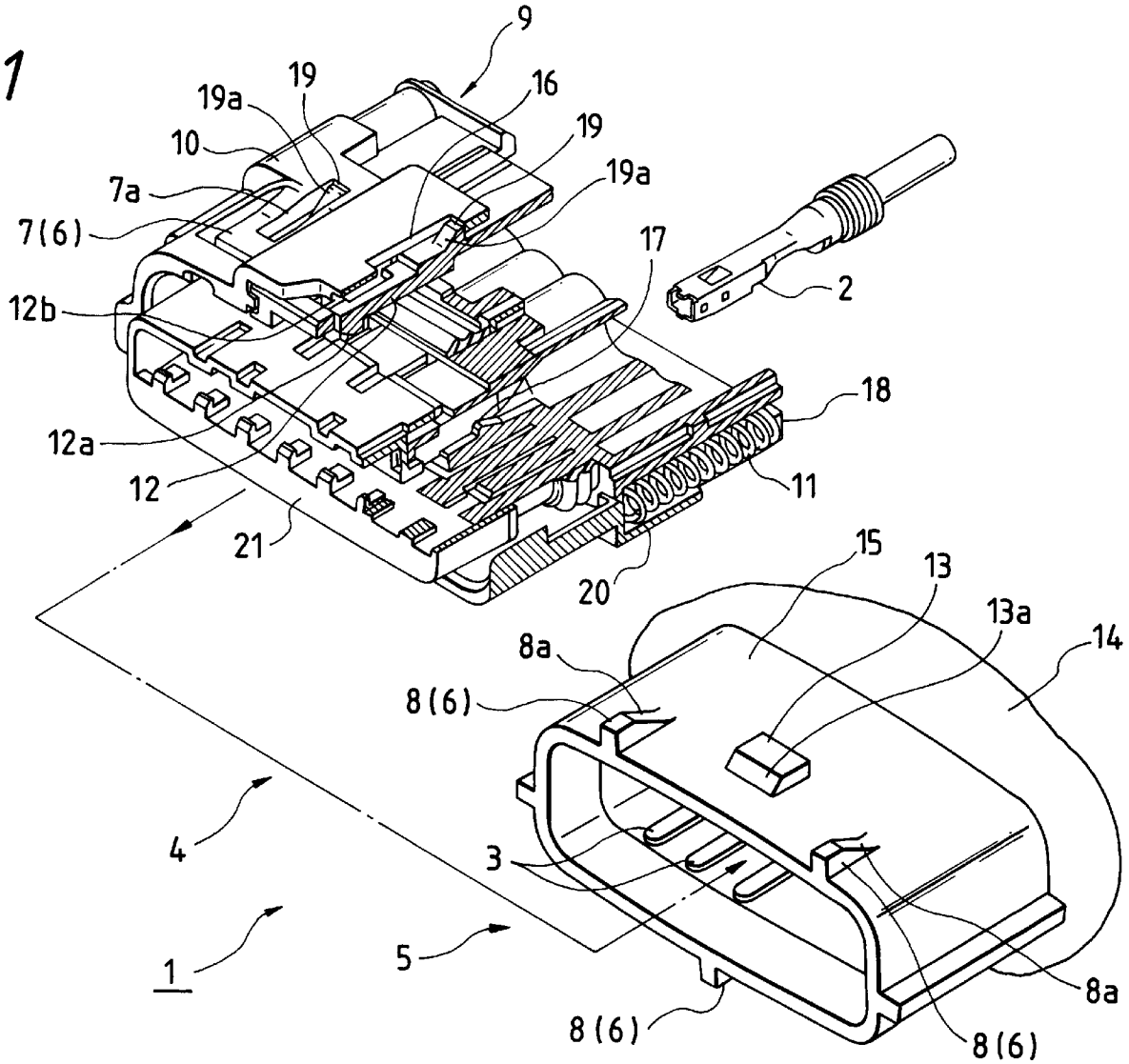
FIG. 1 is a partly-broken, exploded perspective view of one preferred embodiment of a half-fitting prevention connector according to the present invention.
Figure 2:
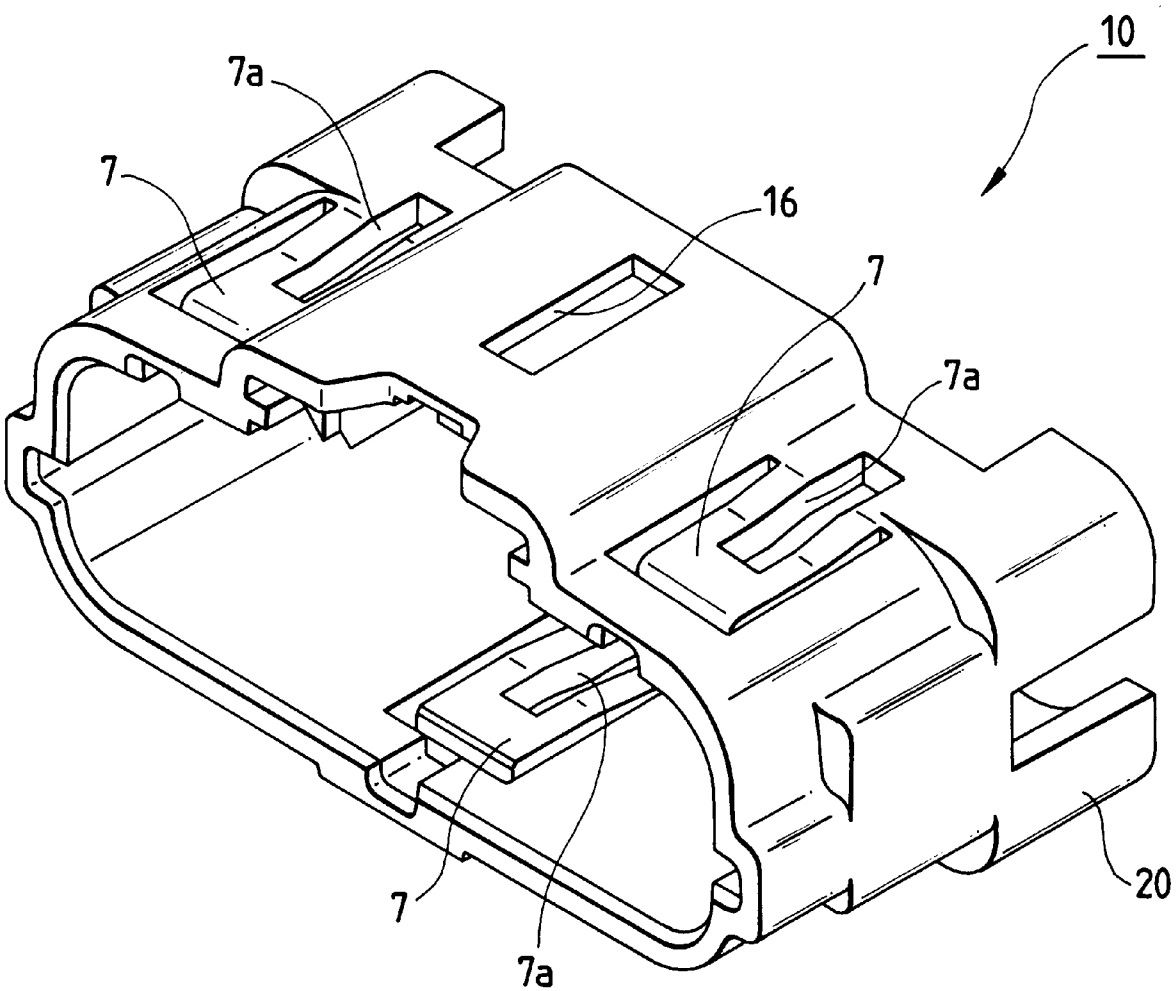
FIG. 2 is a perspective view of a slide member of the connector of FIG. 1.
Figure 3:
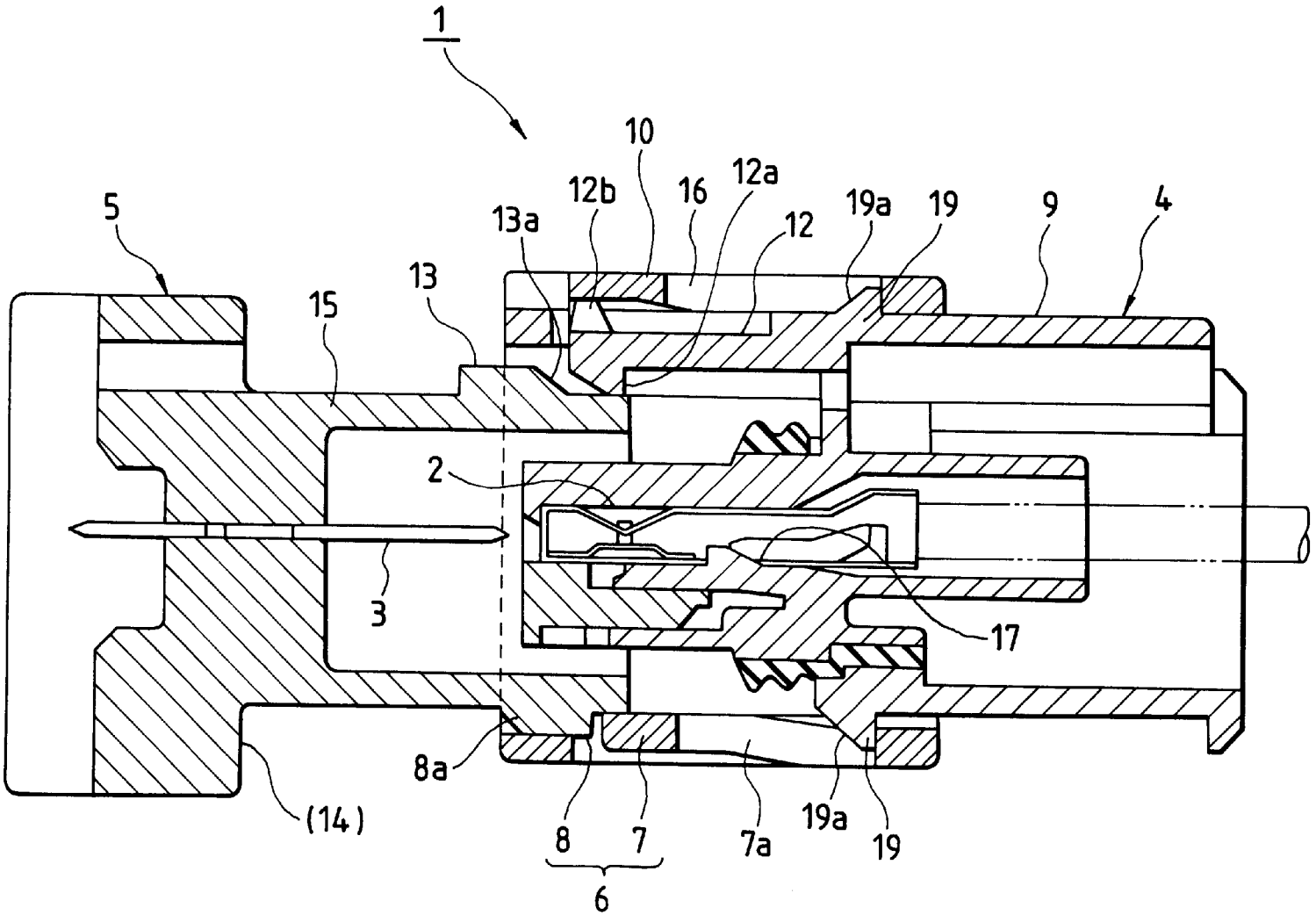
FIG. 3 is a view showing a half-fitted condition of the connector of FIG. 1.
Figure 4:
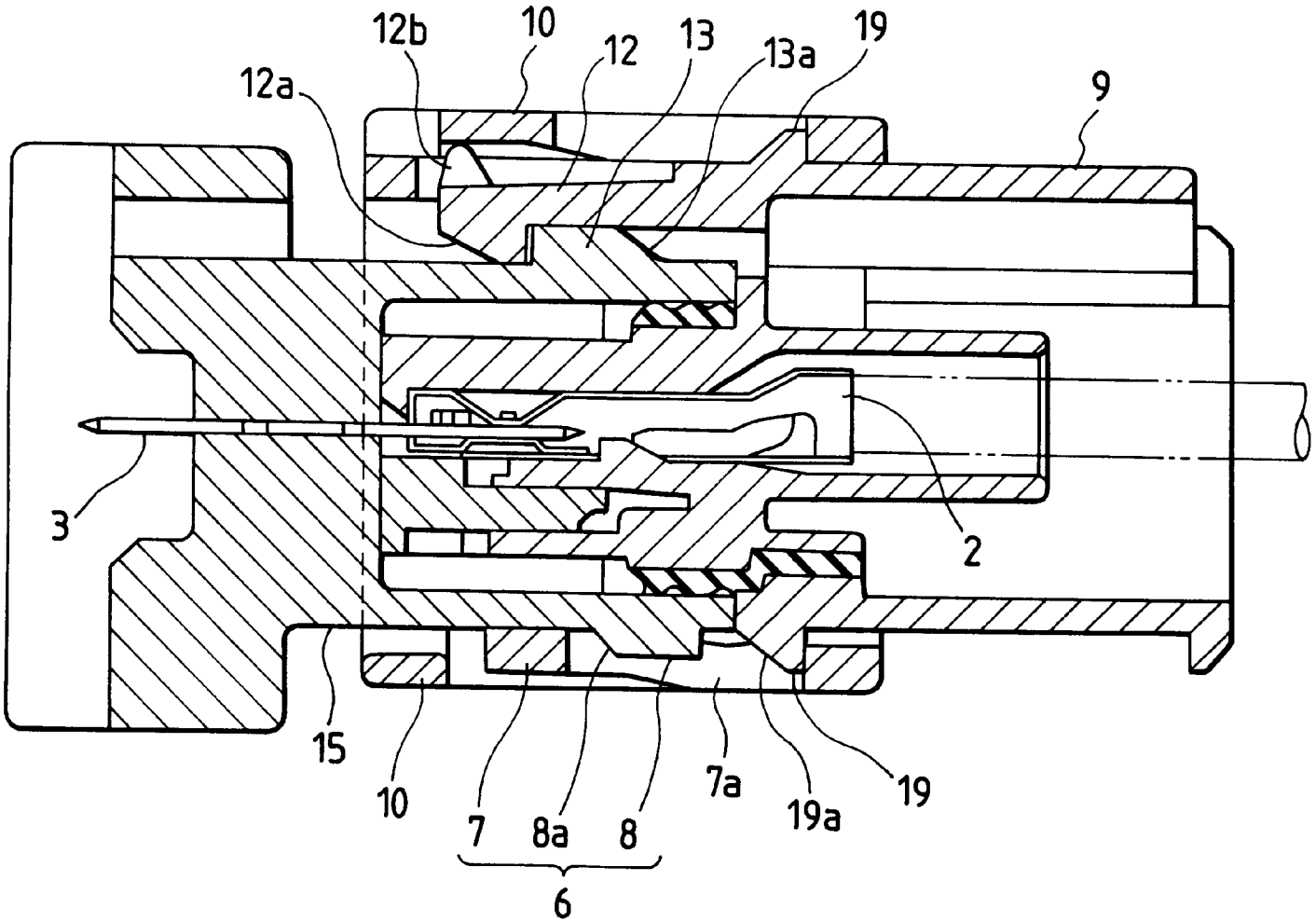
FIG. 4 is a view showing a condition in which the fitting operation in FIG. 3 is completed.
Figure 5:
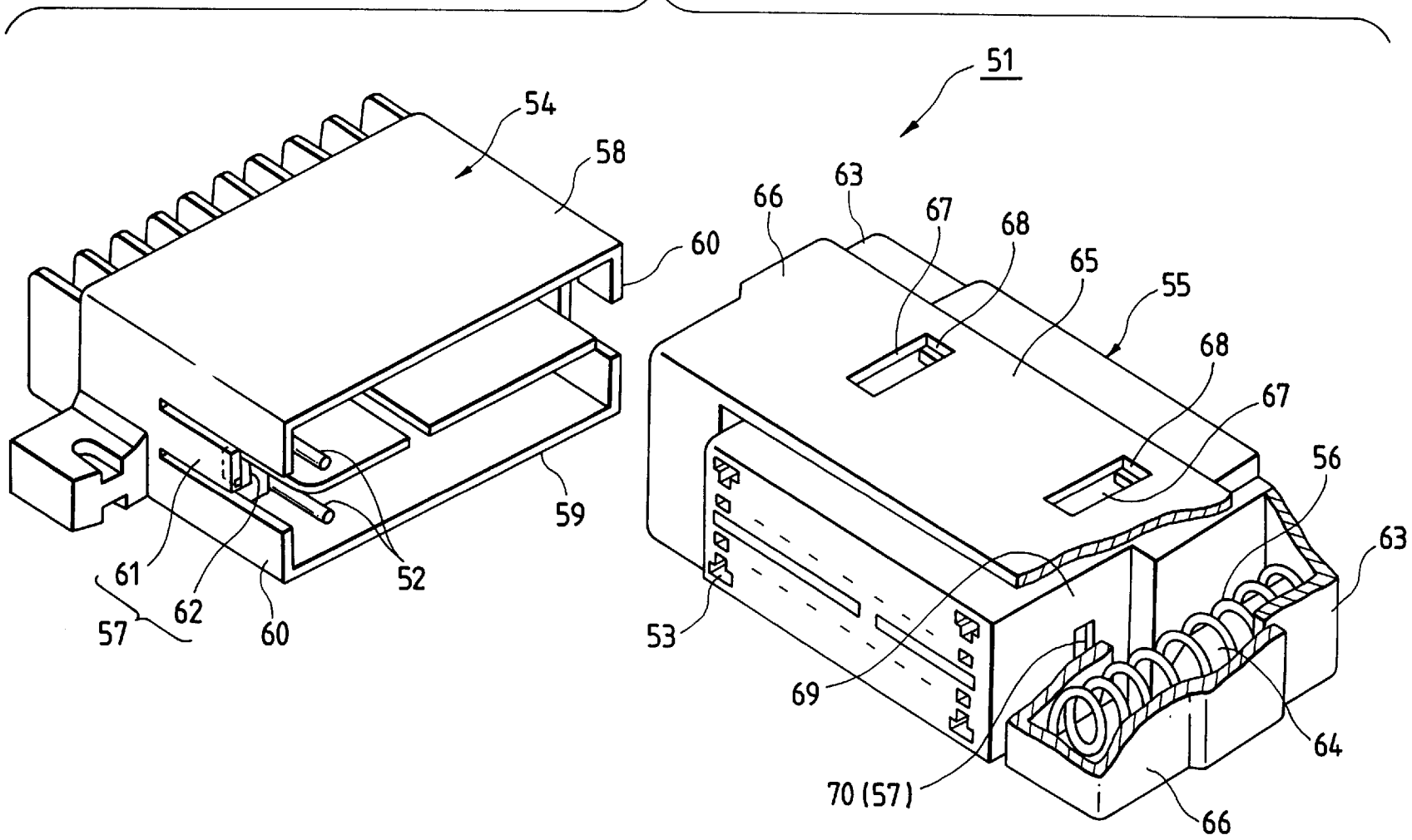
FIG. 5 PRIOR ART
FIG. 5 is a partly-broken, exploded perspective view of a related half-fitting prevention connector.

One preferred embodiment of a half-fitting prevention connector of the present invention will now be described in detail with reference to FIGS. 1 to 4. FIG. 1 is a partly-broken, exploded perspective view of the half-fitting prevention connector of the present invention, FIG. 2 is a perspective view of a slide member of the connector of FIG. 1, FIG. 3 is a view showing a half-fitted condition of the connector of FIG. 1, and FIG. 4 is a view showing a condition in which the fitting operation in FIG. 3 is completed.

As shown in FIGS. 1 to 4, the half-fitting prevention connector 1 comprises half-fitting detection mechanisms 6 for retaining a pair of female and male connectors 4 and 5 each having a suitable number of connection terminals 2 and 3 mounted therein, a movable cover (slide member) 10 slidably mounted on an outer periphery of a housing 9 of one (female connector) of the female and male connectors 4 and 5, and compression springs (resilient members) 11 urging the movable cover 10 in an anti-fitting direction. In this embodiment, three sets of half-fitting detection mechanisms 6 are provided at shells of the female and male connectors 4 and 5 at front end portions thereof, and are arranged generally uniformly around the shells.

Each half-fitting detection mechanism 6 includes an elastic detection piece portion 7 of the cantilever type, which is formed at a shell of the movable cover 10, and extends forwardly slightly inwardly, and a retaining rib 8 formed on that portion of a front end portion of a housing 15 (of the other of the female and male connectors 4 and 5) corresponding to the associated detection piece portion 7. The detection piece portion 7 has a rectangular fitting hole 7*a* formed through its central portion. A slanting surface 8*a* for canceling the fitting connection is formed at a rear side of the retaining rib 8.

A main retaining arm 12 of the cantilever type, which is elastic, is formed on the shell of the housing 9, and extends forwardly, and this arm 12 has a main retaining claw 12*a* formed on an inner face of a distal end portion thereof, and also has a limitation projection 12*b* formed on an outer face of the distal end portion. A main retaining projection 13 is formed on that portion of an outer face of the housing 15 corresponding to the main retaining arm 12. A slot 16 is formed in the movable cover 10 so that the movable cover 10 will not interfere with a stopper projection 19 (described later). The housing 15 of the male connector 5 is fixedly secured to a vehicle body or a wall 14 of a casing of an equipment.

Lances 17 for respectively retaining the female terminals 2 are formed on a bottom wall of the housing 9, and first spring receiving chambers 18 are provided respectively at opposite sides of the housing 9, and support the rear ends of the compression springs 11, respectively. Stopper projections 19 each having slanting surface 19*a* are formed respectively at those portions of the outer wall of the housing 9 corresponding respectively to the half-fitting detection mechanisms 6 and the main retaining arm 12, and these projections 19 limit the forward movement of the movable cover 10. Second spring receiving chambers 20 are provided respectively at opposite sides of the movable cover 10, and support the front ends of the compression springs 11, respectively, to urge the movable cover 10 forward. A front holder 21 is fitted in the open front end of the housing 9, and this front holder 21 guides the male terminals 3, and locks the lances 17 retaining the female terminals 2.

In the half-fitting prevention connector 1 of this embodiment having the above construction, the female terminals 2, each connected to a sheathed wire, are inserted into the housing 9 from the rear side thereof, and are retained respectively by the lances 7, and the front holder 21 is fitted into a lower portion of the front end portion of the housing 9. Then, the compression springs 18 are mounted respectively in the first spring receiving chambers 18 provided respectively at the opposite sides of the housing 9, and then the movable cover 10 is fitted on the housing 9 from the front side thereof, while compressing the compression springs 11, and is retained by the rear end surfaces of the stopper projections 19. The rear end surfaces of the stopper projections 19 retain the rear ends of the fitting holes 7*a* and slot 16, respectively.

The male terminals 3 are inserted into the other housing 15 from the rear side thereof, and are retained therein. Thus, the assembling of each of the female and male connectors 4 and 5 is completed.

Next, for fitting and connecting the female and male connectors 4 and 5 together, generally, the female connector 4 is press to be fitted on the male connector 5 fixedly secured to the casing wall 14 or the like. As a result, first, the front end surface of each retaining rib 8 abuts against the distal end of the associated detection piece portion 7 as shown at a lower portion of FIGS. 3 and 4, so that the movable cover 10 is moved backward while compressing the compression springs 11. Then, the front end of each fitting hole 7*a* reaches the slanting surface 19*a* of the associated stopper projection 19, and raises the detection piece portion 7, so that the retaining rib 8 is fitted into the fitting hole 7*a*, thus completing the fitting connection between the female and male connectors 4 and 5. The movable cover 10 is returned to the foremost position by the urging force of the compression springs 11.

If the operator looses his hold of the female connector before the front end of each fitting hole 7*a* reaches the slanting surface 19*a* of the stopper projection 19, the female and male connectors 4 and 5 are moved away from each other by the urging force of the compression springs 11 through the detection piece portions 7 and the retaining ribs 8.

When the movable cover 10 is moved toward the rear side of the housing 9 (as shown at an upper portion of FIGS. 3 and 4) while each detection piece portion 7 is flexed to receive the associated retaining rib 8 in its fitting hole 7*a* as described above, the limitation projection 12*b* becomes free from the restraint of the movable cover 10. Then, when the fitting operation further proceeds, the main retaining claw 12*a* is brought into engagement with the slanting surface 13*a* of the main retaining projection 13, and slides over the main retaining projection 13 while flexing the main retaining arm 12 moves outwardly, so that the main retaining claw 12*a* is completely retained on the main retaining projection 13. Then, when the movable cover 10 is returned to the foremost position, the limitation projection 12*b* is held against the inner face of the movable cover 10, so that the main retaining arm 12 will not be flexed, and therefore the main retaining claw 12*a* is positively locked to the main retaining projection 13.

For canceling the fitting connection between the female and male connectors 4 and 5, the movable cover 10 is first moved rearward out of engagement with the limitation projection 12*b*. Then, when the housing 9 is moved rearwardly while flexing the main retaining arm 12 outwardly, the main retaining claw 12*a* is released from the main retaining projection 13, and slides over the main retaining projection 13. On the other hand, each retaining rib 8 has the slanting surface 8*a*, and therefore the front end of each fitting hole 7*a* slides over the associated retaining rib 8 while flexing the detection piece portion 7 outwardly, and the female and male connectors 4 and 5 can be moved away from each other. If the movable cover 10 is released at the time when the front end of each detection piece portion 7 slides over the associated retaining rib 8, the female and male connectors 4 and 5 are urged away from each other by the urging force of the compression springs 11.

In the above-mentioned half-fitting prevention connector 1, the female and male connectors 4 and 5 are prevented from remaining in a half-fitted condition by the compression springs (resilient members) 11 acting in the anti-fitting direction. The three sets of half-fitting detection mechanisms 6 are provided at the shells of the female and male connectors 4 and 5 at the front end portions thereof, and are arranged generally uniformly around the shells. Therefore, the movable cover 10 can be pushed without forcible fitting. Therefore, since the force acts uniformly on the three sets of half-fitting detection mechanisms 6, not only the fatigue strength is enhanced but also the half-fitting detection mechanisms 6 will not be locked in a half-fitted condition, and therefore the half-fitted condition can be positively detected. Thus, the half-fitted condition of the female and male connectors 4 and 5 is prevented, and the half-fitting detection mechanisms will not be subjected to fatigue failure, and the fitting operation can be carried out positively and easily, and therefore the reliability of the half-fitting prevention connector is enhanced.

The slide member 10, when located in the foremost position, covers the limitation projection 12*b*, and therefore the main retaining arm 12 and the main retaining claw 12*a* are prevented from movement by the limitation projection 12*b* unless the slide member 10 is intentionally moved rearward, and therefore the main retaining claw 12*a* will not be disengaged from the main retaining projection 13. Therefore, the fitted condition of the female and male connectors 4 and 5 will not be canceled by interference with other member, and the reliability of the half-fitting prevention connector is further enhanced.

The half-fitting prevention connector of the present invention is not limited to the above embodiment, but suitable modifications can be made. For example, in the above embodiment, although the female terminals 2 are received in the female connector 4 while the male terminals 3 are received in the male connector 5, the female terminals may be received in the male connector while the male terminals are received in the female connector. In the above embodiment, although the three detection piece portions 7 are provided on the slide member 10 mounted on the female connector 4, these can be provided on the housing of the male connector 5. In the above embodiment, although the three sets of half-fitting detection mechanisms 6 are provided, four or more sets may be provided.

As has been described heretofore, the half-fitting prevention connector comprises the half-fitting detection mechanisms for detecting the condition of half-fitting between the pair of female and male connectors each having a suitable number of connection terminals mounted therein, the slide member slidably mounted on the outer face of the housing of one of the female and male connectors, and the resilient members urging the slide member in the anti-fitting direction, and not less than three sets of the half-fitting detection mechanisms are provided at the shells of the female and male connectors at the front end portions thereof, and are arranged generally uniformly around the shells.

Therefore, the female and male connectors are prevented from being locked in a half-fitted condition by the resilient members acting in the anti-fitting direction. At least three sets of half-fitting detection mechanisms are provided at the shells of the female and male connectors at the front end portions thereof, and are arranged generally uniformly around the shells. Therefore, the force acts uniformly on the half-fitting detection mechanisms. Therefore, the fatigue strength of the half-fitting detection mechanisms is enhanced, and also the half-fitted condition is positively prevented, and besides the fitting operation can be effected positively and easily, and therefore there can be obtained the half-fitting prevention connector having the high reliability.

In the above half-fitting prevention connector, each of the half-fitting detection mechanisms includes the elastic detection piece portion of the cantilever type, which is formed at the shell of the movable cover, and extends forwardly, and the retaining rib formed on that portion of the front end portion of the housing (of the other of the female and male connectors) corresponding to the associated detection piece portion, and the detection piece portion has the fitting hole formed through its central portion.

The elastic main retaining arm of the cantilever type is formed on the shell of the one housing, and extend forwardly, and the arm has the main retaining claw formed on the inner face of the distal end portion thereof, and also has the limitation projection formed on the outer face of the distal end portion, and the main retaining projection is formed on that portion of the outer face of the other housing corresponding to the main retaining arm, and the slide member, when located in its foremost position, covers the limitation projection.

Thus, in addition to the half-fitting detection mechanism, the main retaining arm, having the main retaining claw and the limitation projection, is provided on the one housing, and the main retaining projection is provided on the other housing. Therefore, the female and male connectors, fitted together, are locked to each other more positively, and there can be provided the half-fitting prevention connector having the higher reliability.

The slide member, when located in its foremost position, covers the limitation projection, and therefore the main retaining arm and the main retaining claw are prevented from movement by the limitation projection unless the slide member is intentionally moved rearward, and therefore the main retaining claw will not be disengaged from the main retaining projection.

Therefore, the fitted condition of the female and male connectors will not be canceled by interference with other member, and there can be provided the half-fitting prevention connector having the higher reliability.

What is claimed is:

1. A connector for preventing a half-fitting thereof comprising:

a first connector housing;

a second connector housing for engaging with the first connector housing;

a slide cover provided so as to cover an outer periphery of the second connector housing, the slide cover capable of sliding on the outer periphery of the second connector housing in a fitting and anti-fitting direction of the first and second connector housing;

a resilient member provided in the second connector housing for urging the slide cover toward said anti-fitting direction; and at least three half-fitting detection mechanisms for detecting the half-fitting of the first and second connector housings, said half-fitting detection mechanisms respectively provided on an outer face of front end portions of the first connector housing and the slide cover, wherein the half-fitting detection mechanisms are arranged such that there are substantially equal intervals therebetween with respect to a circumferential direction of the first connector housing and the slide cover.

2. The connector as set forth in claim 1, wherein each of the half-fitting detection mechanisms comprises a resilient piece rear end which is cantilevered by the slide cover and having a slot, extending in the fitting direction, and a rib for engaging with the slot said rib provided on the first connector housing.

3. The connector as set forth in claim 2, wherein the second connector housing comprises a plurality of stopper projections each having a rear face of which is to be abutted against a rear end of the associated slot in the slide cover to define an initial position of the slide cover, wherein each front face of the ribs is brought into contact with a front end portion of the associated resilient piece to urge the slide cover toward the fitting direction when the slide cover is located at the initial position, and wherein each front face of the plurality of stopper projections is tapered for bending the associated front end portion of the resilient piece outwards to allow each of the ribs to engage with the associated slot when the slide cover is in a fitting position.

4. The connector as set forth in claim 3, wherein the second connector housing further comprises a resilient arm having a projection provided on a bottom face of a front end portion thereof and wherein the first connector housing further comprises a retaining projection for engaging with the resilient arm, wherein the retaining projection is to be abutted against an inner face of the slide cover when the slide cover is located at the initial position, and a front face of the retaining projection is tapered to bend the resilient arm outwards when the slide cover is slid by the ribs.

* * * * *